US011273386B2

(12) United States Patent
Deng et al.

(10) Patent No.: US 11,273,386 B2
(45) Date of Patent: Mar. 15, 2022

(54) MULTI-DIMENSIONAL BUILDING BLOCK TOY BUILDING COMPONENT AND SET CAPABLE OF BEING BUILT FREELY ON FRONT AND BACK SIDES

(71) Applicant: SHANGHAI PAI TECHNOLOGY CO., LTD., Shanghai (CN)

(72) Inventors: Shanjun Deng, Shanghai (CN); Ye Xiao, Shanghai (CN)

(73) Assignee: SHANGHAI PAI TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 17/044,717

(22) PCT Filed: Mar. 14, 2019

(86) PCT No.: PCT/CN2019/078062
§ 371 (c)(1),
(2) Date: Dec. 31, 2020

(87) PCT Pub. No.: WO2019/196591
PCT Pub. Date: Oct. 17, 2019

(65) Prior Publication Data

US 2021/0205728 A1 Jul. 8, 2021

(30) Foreign Application Priority Data

Apr. 9, 2018 (CN) ..... 201810313213.8

(51) Int. Cl.
*A63H 33/08* (2006.01)

(52) U.S. Cl.
CPC ..... *A63H 33/086* (2013.01)

(58) Field of Classification Search
CPC ..... A63H 33/086
See application file for complete search history.

(56) References Cited

U.S. PATENT DOCUMENTS 3,005,282 A * 10/1961 Godtfred ..... A63H 33/086 446/128
3,528,192 A * 9/1970 Meates ..... A63H 33/086 446/113

(Continued)

FOREIGN PATENT DOCUMENTS

CN 106955495 A 7/2017
CN 108704323 A * 10/2018 ..... A63H 33/08

(Continued)

OTHER PUBLICATIONS

Xie, Machine Translation of CN108704323A, uploaded Jul. 26, 2021, Espacenet, 9 pages.*

(Continued)

*Primary Examiner* — Eugene L Kim
*Assistant Examiner* — Matthew B Stanczak
(74) *Attorney, Agent, or Firm* — Bayramoglu Law Offices LLC

(57) ABSTRACT

A multidimensional front-and-back-sides-freely-buildable building block toy construction set includes a first module and a second module. The first module is provided with a single, a single column of, two columns of or multiple columns of first coupling short posts on a front side, and is provided with a concave surface on a back side. Multiple columns of protruding second coupling short posts are disposed on the concave surface. The second coupling short posts are distributed as follows: columns: uniformly distributed in the same columns as the first coupling short posts on the front side, and in the middle equally dividing two adjacent columns; rows: in the same columns as the first coupling short posts on the front side, each of the second coupling short posts is alternately arranged with the first coupling short posts, and is located in the middle equally dividing two first coupling short posts.

21 Claims, 10 Drawing Sheets

(56) References Cited

U.S. PATENT DOCUMENTS 3,570,170 A * 3/1971 Kishi ..... A63H 33/086 446/128
3,597,875 A * 8/1971 Christiansen ..... A63H 33/086 446/128
3,716,939 A * 2/1973 Pibet ..... A63H 33/086 446/128
4,744,780 A * 5/1988 Volpe ..... A63H 33/086 403/300
D378,837 S * 4/1997 Olsen ..... D21/500
D378,838 S * 4/1997 Olsen ..... D21/486
5,683,283 A * 11/1997 Glynn ..... A63H 33/086 446/128
5,779,515 A * 7/1998 Chung ..... A63H 33/04 446/102
6,102,766 A * 8/2000 Leadbetter ..... A63H 33/086 446/128
6,554,676 B1 * 4/2003 Bach ..... A63H 33/086 446/116
6,645,033 B1 11/2003 Thomsen
7,347,028 B1 * 3/2008 Bin-Nun ..... A63H 33/086 446/112
9,345,981 B1 * 5/2016 Lama ..... A63H 33/08
10,786,748 B2 * 9/2020 Deng ..... A63H 33/086
2010/0203796 A1 * 8/2010 Beg ..... A63H 33/086 446/120
2011/0021107 A1 * 1/2011 Nag ..... A63H 33/042 446/91
2013/0252503 A1 * 9/2013 Kwok ..... A63H 33/062 446/102
2013/0330999 A1 * 12/2013 Ryaa ..... A63H 33/086 446/124
2014/0011422 A1 * 1/2014 Channin ..... A63H 33/08 446/85
2014/0227937 A1 * 8/2014 Pai-Chen ..... A63H 33/107 446/122
2014/0256211 A1 * 9/2014 Cheng ..... A63H 33/086 446/125
2015/0314209 A1 * 11/2015 Brooks ..... A63H 3/46 446/128
2015/0321114 A1 * 11/2015 Broyles ..... A63H 33/14 446/124
2018/0099233 A1 * 4/2018 Peiler ..... A63H 33/086
2018/0256997 A1 * 9/2018 Barwald ..... A63H 33/08
2019/0022543 A1 * 1/2019 Takeda ..... A63H 33/086
2019/0358558 A1 * 11/2019 Barwald ..... A63H 33/086
2021/0154590 A1 * 5/2021 Ishimatsu ..... A63H 33/086

FOREIGN PATENT DOCUMENTS

FR 1206687 A 2/1960
FR A563746 A1 * 11/1985 ..... A63H 33/08

OTHER PUBLICATIONS

Albert, Machine Translation of FR2563746A1, uploaded Jul. 26, 2021, Espacenet, 4 pages.*

* cited by examiner

MULTI-DIMENSIONAL BUILDING BLOCK TOY BUILDING COMPONENT AND SET CAPABLE OF BEING BUILT FREELY ON FRONT AND BACK SIDES

CROSS REFERENCE TO THE RELATED APPLICATIONS

This application is the national phase entry of International Application No. PCT/CN2019/078062, filed on Mar. 14, 2019, which is based upon and claims priority to Chinese Patent Application No. 201810313213.8, filed on Apr. 9, 2018, the entire contents of which are incorporated herein by reference.

TECHNICAL FIELD

The present invention relates to the field of building block toy construction sets, and more particularly, to a multidimensional freely-buildable building block toy construction element and set.

BACKGROUND

Building block toy is a toy for building a plurality of building blocks together to realize a creative idea of a builder. In order to build diversified toys, generally a plurality of modules designed in different standards are provided, for example, as shown in FIG. 1, a module A is provided with a plurality of protruding coupling short posts h on a front side. As shown in FIG. 2, the module A is provided with a concave surface on a back side; one or more protruding coupling short posts i are disposed on the concave surface; and a plurality of ribs are disposed on a side wall of the concave surface. As shown in FIG. 3, a module B is provided with a plurality of protruding coupling short posts j on a front side; as shown in FIG. 4, the module B is provided with a concave surface on a back side, and one or more protruding coupling short posts k are disposed on the concave surface.

The building block building methods in the prior art are three:

The building of the module A itself: the building blocks are built by coupling the coupling short posts h on the front side of the module A, the coupling short posts i on the back side, and the ribs on the side wall on the back side to form friction.

The building between the front side of the module A and the back side of the module B: the building blocks are built by coupling the coupling short posts k and the coupling short posts h to form friction.

The building between the back side of the module A and the front side of the module B: the building blocks are built by coupling the coupling short posts j of the module B and the ribs on the side wall on the back side of the module A to form friction. The methods have a lot of limitations; as shown in FIGS. 5 and 6, the sizes of the coupling posts on the front side of the module B and on the back side of the module A are inappropriate, and the coupling posts cannot be well coupled.

As described above, the existing building block toy construction set can only provide three building methods, and cannot provide a building method for the building between the back side of the module A and the back side of the module B; furthermore, the method constrainedly provided for the building between the back side of the module A and the front side of the module B has a lot of limitations. With the defects, using a building block toy construction set to build a multidimensional and multi-degree-of-freedom toy is greatly limited, and the creative idea of the builder cannot be freely realized.

The object of the present invention is to provide a multidimensional front-and-back-sides-freely-buildable building block toy construction element and set, so as to ensure the degree of freedom in multidimensional building block building.

SUMMARY

The present invention provides a multidimensional front-and-back-sides-freely-buildable building block toy construction set. The technical solution is as follows:

A multidimensional front-and-back-sides-freely-buildable building block toy construction set, comprising a first module and a second module, wherein the first module is provided with first coupling short posts (r) on the front side, and is provided with a concave surface on the back side; protruding second coupling short posts (t) are disposed on the concave surface; the second coupling short posts (t) are distributed as follows:

columns: uniformly distributed in the same columns as the first coupling short posts (r) on the front side, and in the middle equally dividing two adjacent columns;

rows: in the same columns as the first coupling short posts (r) on the front side, wherein each of the second coupling short posts (t) is alternately arranged with the first coupling short posts (r), and is located in the middle equally dividing two first coupling short posts (r);

in the column located at a middle position equally dividing two adjacent columns of the first coupling short posts (r), each of the second coupling short posts (t) is located at a middle position equally dividing two first coupling short posts (r) in the same row;

the second module is provided with third coupling short posts (s) on a front side; the third coupling short post (s) is a cylinder penetrating the second module;

the second module is provided with a concave surface on a back side; protruding fourth coupling short posts (u) are disposed on the concave surface; the fourth coupling short posts (u) on the back side of the second module are distributed as follows:

columns: located in the middle equally dividing two adjacent columns of the third coupling short posts (s) on the front side;

rows: each of the fourth coupling short posts (u) is located in the middle equally dividing two third coupling short posts (s);

the outer diameter of the first coupling short post (r) is a first size; the outer diameter of the second coupling short post (t), the outer diameter of the third coupling short post (s) and the outer diameter of the fourth coupling short post (u) are all a second size; the first module and the second module are adapted to be inserted into each other.

The multidimensional front-and-back-sides-freely-buildable building block toy construction set as described above, wherein the first size and the second size are different.

The multidimensional front-and-back-sides-freely-buildable building block toy construction set as described above, wherein the first size is greater than the second size.

The multidimensional front-and-back-sides-freely-buildable building block toy construction set as described above, wherein the nearest distance between peripheries of two adjacent first coupling short posts (r) on the front side of the first module is the second size;

the nearest distance between peripheries of two adjacent second coupling short posts (t) located in the same row on the back side of the first module is the first size; the nearest distance between peripheries of two adjacent second coupling short posts (t) located in the same column is the first size; and the front side of the first module is adapted to be inserted into the back side of another first module.

The multidimensional front-and-back-sides-freely-buildable building block toy construction set as described above, wherein the nearest distance between peripheries of two diagonally adjacent third coupling short posts (s) on the front side of the second module is the second size;

the nearest distance between peripheries of two diagonally adjacent fourth coupling short posts (u) on the back side of the second module is the second size;

the front side of the second module is adapted to be inserted into the back side of another second module.

The multidimensional front-and-back-sides-freely-buildable building block toy construction set as described above, wherein the front side of the second module is adapted to be inserted into the front side of another second module.

The multidimensional front-and-back-sides-freely-buildable building block toy construction set as described above, wherein the nearest distance between peripheries of two coupling short posts (s) spaced apart by one third coupling short post (s) in the same row or column on the front side of the second module is the first size; and the front side of the first module is adapted to be inserted into the front side of the second module.

The multidimensional front-and-back-sides-freely-buildable building block toy construction set as described above, wherein the nearest distance between peripheries of two coupling short posts (u) spaced apart by one fourth coupling short post (u) in the same row or column on the back side of the second module is the first size; and the front side of the first module is adapted to be inserted into the back side of the second module.

The multidimensional front-and-back-sides-freely-buildable building block toy construction set as described above, wherein the nearest distance between two second coupling short posts (t) in a diagonal direction on the back side of the first module is the second size;

the back side of the first module is adapted to be inserted into the back side of the second module; and the back side of the first module is adapted to be inserted into the front side of the second module.

The multidimensional front-and-back-sides-freely-buildable building block toy construction set as described above, wherein a plurality of ribs are disposed on a side wall of the concave surface on the back side of the first module; a plurality of ribs are disposed on a side wall of the concave surface on the back side of the second module; the ribs are perpendicular to the side wall, and are arranged in rows or columns directly opposite to the fourth coupling short posts (u).

The multidimensional front-and-back-sides-freely-buildable building block toy construction set as described above, wherein when the number of the first coupling short posts (r) on the front side of the first module is the same as the number of the rows or columns of the third coupling short posts (s) on the front side of the second module, the width or length of the first module is two times that of the second module.

The multidimensional front-and-back-sides-freely-buildable building block toy construction set as described above, wherein when the second module is provided with two third coupling short posts (s) in the same row, the relationship between the outer diameter of the second coupling short post (t), the outer diameter of the third coupling short post (s) and the outer diameter of the fourth coupling short post (u) and the width size of the second module is:

The outer diameter of the coupling short post is: $d(t)=d(s)=d(u)=X/2-g*2-h*2$ wherein X is the width of the second module; g is a wall thickness of the side wall of the second module; and h is a thickness of the ribs on the side wall of the second module.

The multidimensional front-and-back-sides-freely-buildable building block toy construction set as described above, wherein the diameter d(r) of the first coupling short post (r)=a distance f between circle centers of two adjacent second coupling short posts (t)−d(t); and the distance f between the circle centers of two adjacent second coupling short posts (t) is the same as the width of the second module.

The multidimensional front-and-back-sides-freely-buildable building block toy construction set as described above, wherein the width of the second module is 20 mm; the wall thickness g of the side wall of the second module is 1.2 mm; the thickness h of the ribs on the side wall of the second module is 0.25 mm; the outer diameter d(s) of the second coupling short post (s) equals the outer diameter d(t) of the third coupling short post (t), equals the outer diameter d(u) of the fourth coupling short post (u), and equals 7.1 mm.

The multidimensional front-and-back-sides-freely-buildable building block toy construction set as described above, wherein the diameter d(r) of the first coupling short post (r) is equal to the distance f between the circle centers of two adjacent second coupling short posts (t) minus d(t), i.e., 20−7.1=12.9 mm.

The present invention further provides a multidimensional front-and-back-sides-freely-buildable building block toy construction element. The technical solution is as follows:

A multidimensional front-and-back-sides-freely-buildable building block toy construction element, comprising a first module, wherein the first module is provided with first coupling short posts (r) on a front side, and is provided with a concave surface on a back side; multiple columns of protruding second coupling short posts (t) are disposed on the concave surface; the second coupling short posts (t) are distributed as follows:

columns: uniformly distributed in the same columns as the first coupling short posts (r) on the front side, and located at middle positions equally dividing two adjacent columns;

rows: in the same columns as the first coupling short posts (r) on the front side, each of the second coupling short posts (t) is alternately arranged with the first coupling short posts (r), and is located in the middle equally dividing two first coupling short posts (r);

in the column located at a middle position equally dividing two adjacent columns of the first coupling short posts (r), each of the second coupling short posts (t) is located at a middle position equally dividing two first coupling short posts (r) in the same row;

the outer diameter of the first coupling short post (r) on the front side of the first module is a first size; the nearest distance between peripheries of two adjacent first coupling short posts (r) on the front side is a second size; the outer diameter of the second coupling short post (t) on the back side of the first module is the second size; the nearest distance between peripheries of two adjacent second coupling short posts (t) in the same row is the first size; the nearest distance between peripheries of two adjacent second coupling short posts (t) in the same column is the first size;

the front side of the first module is adapted to be inserted into the back side of another first module;

the first module is adapted to be inserted into a second module; the second module is provided with third coupling short posts (s) on a front side, and fourth coupling short posts (u) on a back side; and the outer diameter of the third coupling short post (s) and the outer diameter of the fourth coupling short post (u) are both the second size.

The multidimensional front-and-back-sides-freely-buildable building block toy construction element as described above, wherein the third coupling short post (s) on the front side of the second module is a cylinder penetrating the second module;

the second module is provided with a concave surface on the back side; protruding fourth coupling short posts (u) are disposed on the concave surface; the fourth coupling short posts (u) on the back side of the second module are distributed as follows:

columns: located in the middle equally dividing two adjacent columns of the third coupling short posts (s) on the front side;

rows: each of the fourth coupling short posts (u) is located in the middle equally dividing two third coupling short posts (s).

The multidimensional front-and-back-sides-freely-buildable building block toy construction element as described above, wherein the nearest distance between peripheries of two coupling short posts (s) spaced apart by one third coupling short post (s) in the same row or column on the front side of the second module is the first size; and the front side of the first module is adapted to be inserted into the front side of the second module.

The multidimensional front-and-back-sides-freely-buildable building block toy construction element as described above, wherein the nearest distance between peripheries of two coupling short posts (u) spaced apart by one fourth coupling short post (u) in the same row or column on the back side of the second module is the first size; and the front side of the first module is adapted to be inserted into the back side of the second module.

The multidimensional front-and-back-sides-freely-buildable building block toy construction element as described above, wherein the nearest distance between two second coupling short posts (t) in a diagonal direction on the back side of the first module is the second size;

the back side of the first module is adapted to be inserted into the back side of the second module; and the back side of the first module is adapted to be inserted into the front side of the second module.

The present invention further provides another multidimensional front-and-back-sides-freely-buildable building block toy construction element. The technical solution is as follows:

The multidimensional front-and-back-sides-freely-buildable building block toy construction element, comprising a second module, wherein the second module is adapted to be inserted into a first module; the first module is provided with first coupling short posts (r) on a front side, and second coupling short posts (t) on a back side;

the second module is provided with third coupling short posts (s) on a front side; the third coupling short post (s) is a cylinder penetrating the second module;

the second module is provided with a concave surface on a back side; protruding fourth coupling short posts (u) are disposed on the concave surface; the fourth coupling short posts (u) on the back side of the second module are distributed as follows:

columns: located in the middle equally dividing two adjacent columns of the third coupling short posts (s) on the front side;

rows: each of the fourth coupling short posts (u) is located in the middle equally dividing two third coupling short posts (s);

the outer diameter of the first coupling short post (r) is a first size; the outer diameter of the second coupling short post (t), the outer diameter of the third coupling short post (s) and the outer diameter of the fourth coupling short post (u) are all a second size.

The multidimensional front-and-back-sides-freely-buildable building block toy construction element as described above, wherein the nearest distance between peripheries of two diagonally adjacent third coupling short posts (s) on the front side of the second module is the second size;

the nearest distance between peripheries of two diagonally adjacent fourth coupling short posts (u) on the back side of the second module is the second size;

the front side of the second module is adapted to be inserted into the back side of another second module; and the front side of the second module is adapted to be inserted into the front side of another second module.

The multidimensional front-and-back-sides-freely-buildable building block toy construction element as described above, wherein the first module is provided with a concave surface on the back side; multiple columns of protruding second coupling short posts (t) are disposed on the concave surface; the second coupling short posts (t) are distributed as follows:

columns: uniformly distributed in the same columns as the first coupling short posts (r) on the front side, and located at middle positions equally dividing two adjacent columns;

rows: in the same columns as the first coupling short posts (r) on the front side, each of the second coupling short posts (t) is alternately arranged with the first coupling short posts (r), and is located in the middle equally dividing two first coupling short posts (r);

in the column located at a middle position equally dividing two adjacent columns of the first coupling short posts (r), each of the second coupling short posts (t) is located at a middle position equally dividing two first coupling short posts (r) in the same row;

the nearest distance between peripheries of two adjacent first coupling short posts (r) on the front side of the first module is the second size;

The multidimensional front-and-back-sides-freely-buildable building block toy construction element as described above, wherein the nearest distance between peripheries of two coupling short posts (s) spaced apart by one third coupling short post (s) in the same row or column on the front side of the second module is the first size; and the front side of the first module is adapted to be inserted into the front side of the second module.

The multidimensional front-and-back-sides-freely-buildable building block toy construction element as described above, wherein the nearest distance between peripheries of two coupling short posts (u) spaced apart by one fourth coupling short post (u) in the same row or column on the back side of the second module is the first size; and the front side of the first module is adapted to be inserted into the back side of the second module.

The multidimensional front-and-back-sides-freely-buildable building block toy construction element as described above, wherein the nearest distance between two second coupling short posts (t) in a diagonal direction on the back side of the first module is the second size;

the back side of the first module is adapted to be inserted into the back side of the second module; and the back side of the first module is adapted to be inserted into the front side of the second module.

Beneficial Effects

Compared with the prior art, the present invention has the following advantages and beneficial effects:

Apart from the building of a module C itself and the free building of conventional building blocks, the present invention provides freer building capability and building hand feeling in the following various building methods:

I. The coupling between a front side of the module C and a back side of a module D: the coupling short posts r are coupled to the coupling short posts u and the side wall of the module D to generate friction. The deformation of the side wall is little, such method can better control coupling friction and experience hand feeling.

II. The coupling between a back side of the module C and a front side of the module D: a side wall of the module C and the coupling short posts t are coupled to the coupling short posts s on the front side of the module D to generate friction. The design of the present invention can realize coupling at any place.

III. The coupling between the back side of the module C and the back side of the module D: the coupling short posts s, t, and u have the same diameter; and therefore, the back side of the module C and the back side of the module D can be coupled and built at will.

IV. The coupling between the front side of the module C and the front side of the module D: in the present invention, the coupling short posts s and u on the front side and back side of the module have the same diameter; therefore, besides that the back side of the module D can be coupled to the front side of the module C, the front side thereof can also be coupled to the front side of the module C at will; the feature will be more prominent especially when the module C is a very large flat board component (for example, 50 CM*50 CM) (FIGS. 17 and 18).

V. The coupling between the front side of the module D and the front side of the module D:

VI. The coupling between the front side of the module D and the back side of the module D:

VII. The coupling between the front side of the module C and the front side of the module C:

VIII. The coupling between the back side of the module C and a front side of a module L: the module L is an implementation case of the module C, and is provided with only one coupling short post on the front side; furthermore, the diameter of the coupling short post is the same as r; therefore, the module L can be coupled to any position on the back side of the module C, thereby providing quite a lot of changes and design space.

IX. The coupling short posts on the front side of the module C/D are not limited to 8; the figure in the document is only exemplary; the coupling short posts can be numerous such as 1, 2, 3 . . . 5 . . . 10 . . . 20 . . . 50 . . . and the like, thereby providing imaginable building pleasure. Rounded corners at the edges of the modules are such designed that the coupling posts of the modules and the rounded corners at the edge have the same center of circle; a plurality of unit modules can be built to form a uniform matched curved surface, thereby having a more comfortable hand feeling; the built appearance is more uniform, freer, safer, and have better hand feeling; the modules are easier to build different series and different designs of toys, thereby realizing rich creative ideas of a builder.

BRIEF DESCRIPTION OF THE DRAWINGS

The present invention will be described in detail hereafter in combination with the drawings and specific embodiments.

DETAILED DESCRIPTION OF THE EMBODIMENTS

The present invention provides a multidimensional front-and-back-sides-freely-buildable building block toy construction set, which improves the degree of freedom in building block building.

In order to easily understand the measures, creative features, objectives to be achieved, and effects realized by the technology of the present invention, the present invention will be further described hereafter in combination with specific figures.

Figure 1:
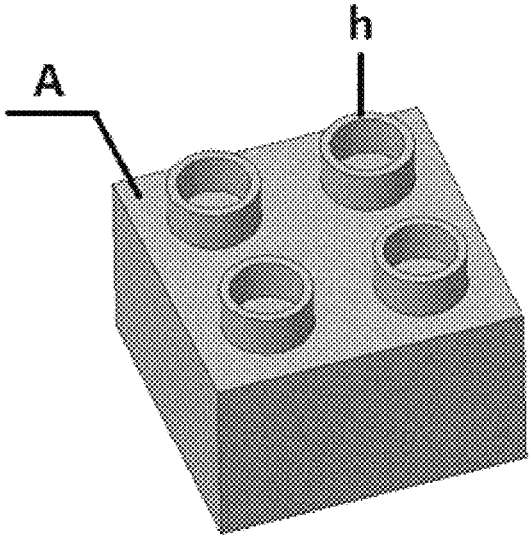
FIG. 1 is a schematic view of the front side of the module A of the existing building block construction set.
Figure 2:
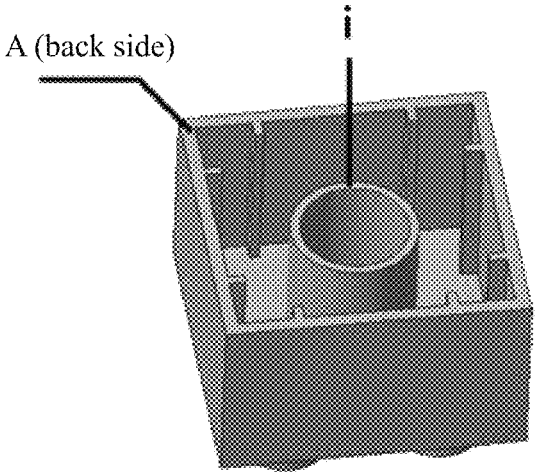
FIG. 2 is a schematic view of the back side of the module A of the existing building block construction set.
Figure 3:
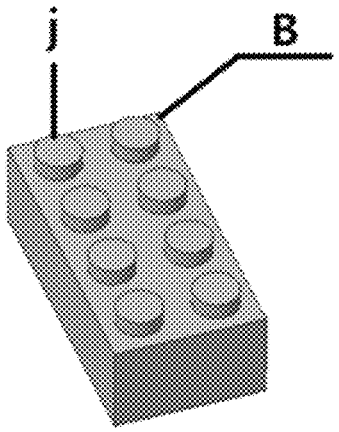
FIG. 3 is a schematic view of the front side of the module B of the existing building block construction set.
Figure 4:
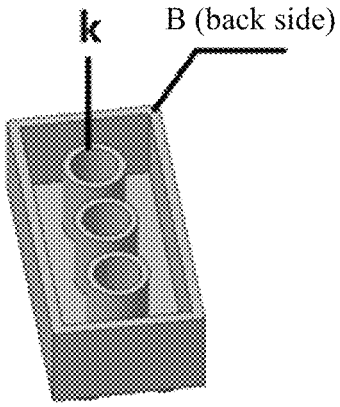
FIG. 4 is a schematic view of the back side of the module B of the existing building block construction set.
Figure 5:
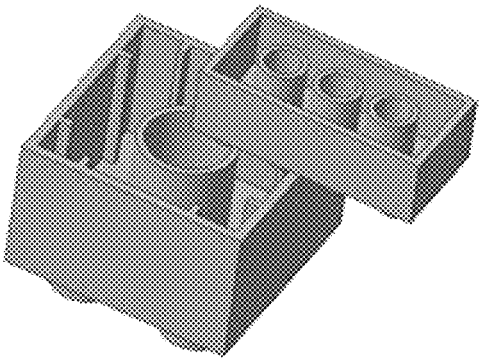
FIG. 5 is a schematic view showing the building between the back side of the module A and the front side of the module B.
Figure 6:
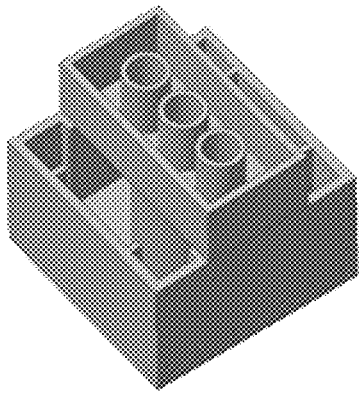
FIG. 6 is a schematic view showing the building between the back side of the module A and the front side of the module B at a randomly changed position.
Figure 7:
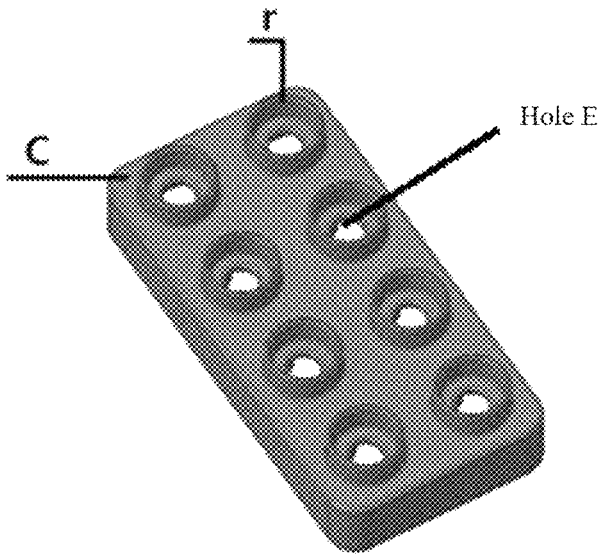
FIG. 7 is a schematic view of the front side of the module C (first module) according to the present invention.

FIG. 7 is a schematic view of the front side of the module C (first module) according to the present invention. As shown in FIG. 7, the module C is provided with multiple columns of coupling short posts r; and the coupling short post r is a cylinder penetrating the module C, and is provided with the hole E in the middle.

Figure 8:
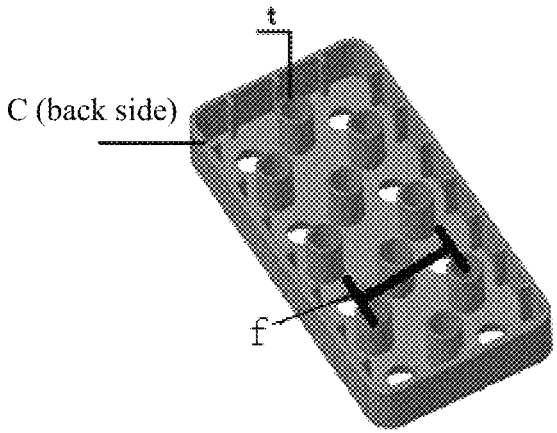
FIG. 8 is a schematic view of the back side of the module C according to the present invention.

FIG. 8 is a schematic view of the back side of the module C according to the present invention. As shown in FIG. 8, the module C is provided with a concave surface; multiple columns of protruding coupling short posts t are disposed on the concave surface; and a plurality of ribs are disposed on a side wall of the concave surface. The distribution of the coupling short posts t on the back side of the module C is designed as follows: columns: uniformly distributed in the same columns as the coupling short posts r on the front side, and in the middle equally dividing two adjacent columns; rows: in the same columns as the coupling short posts r on the front side, each of the coupling short posts t is alternately arranged with the coupling short posts r, and is located in the middle equally dividing two coupling short posts r. Therefore, in such columns, the number of the coupling short posts t is one less than the number of the coupling short posts r. In the column located at the middle position equally dividing two adjacent columns of coupling short posts r, each coupling short post t is located at the middle position equally dividing two coupling short posts r in the same row. Therefore, in such columns, the number of the coupling short posts t is the same as the number of the coupling short posts r.

Figure 9:
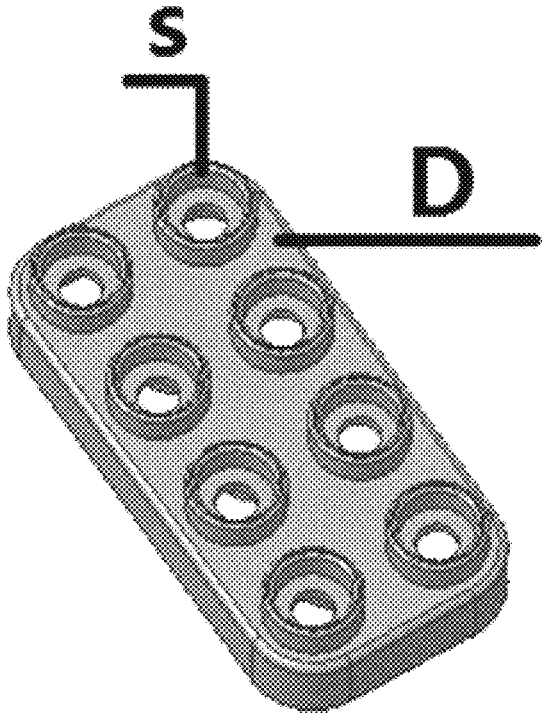
FIG. 9 is a schematic view of the front side of the module D (second module) according to the present invention.

FIG. 9 is a schematic view of the front side of the module D (second module). As shown in FIG. 9, the module D is provided with multiple columns of coupling short posts s; and the coupling short post s is a cylinder penetrating the module D. The number of the coupling short posts s is the same as the number of the coupling short posts r of the module C.

Figure 10:
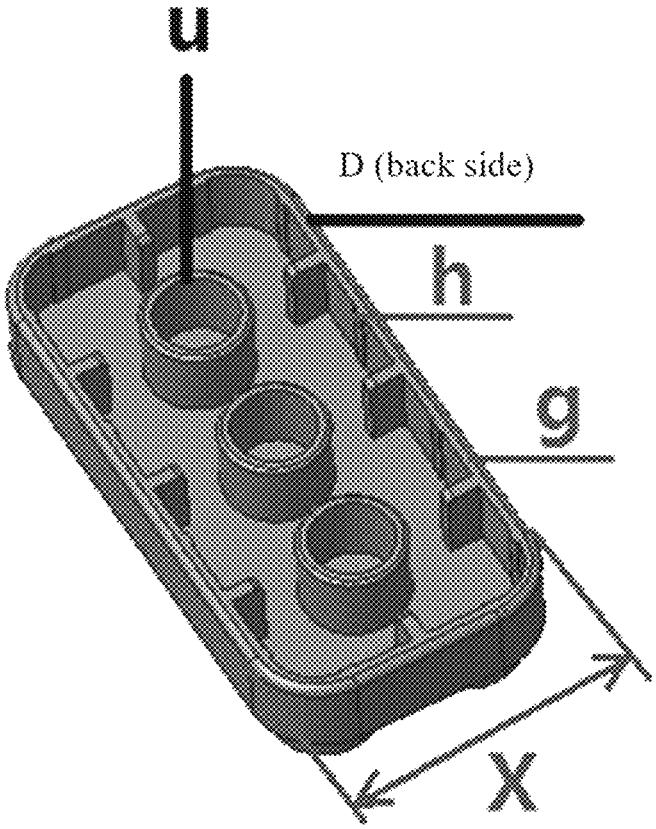
FIG. 10 is a schematic view of the back side of the module D according to the present invention.

FIG. 10 is a schematic view of the back side of the module D according to the present invention. As shown in FIG. 10, the module D is provided with a concave surface; the protruding coupling short posts u are disposed on the concave surface; and a plurality of ribs directly opposite to the coupling short posts u are disposed on the four side walls of the concave surface. The distribution of the coupling short posts u on the back side of the module D is designed as follows: columns: located in the middle equally dividing two adjacent columns of the coupling short posts s on the front side; rows: each coupling short post u is located in the middle equally dividing two coupling short posts s. Therefore, in each column, the number of the coupling short posts u is one less than the number of the coupling short posts s.

The outer diameter of the first coupling short post r is a first size; the outer diameter of the second coupling short post t, the outer diameter of the third coupling short post s and the outer diameter of the fourth coupling short post u are all a second size; the module C and the module D are adapted to be inserted into each other.

In one embodiment of the present invention, the first size is different from the second size. In another embodiment, the first size is greater than the second size.

In one embodiment of the present invention, the nearest distance between the peripheries of two adjacent coupling short posts r on the front side of the module C is the second size. The nearest distance between the peripheries of two adjacent coupling short posts t located in the same row on the back side of the module C is the first size; and the nearest distance between the peripheries of two adjacent coupling short posts t located in the same column is the first size. In this way, the modules can be inserted freely in the following insertion modes: the front side of the module C is inserted into the back side of another module C.

Figure 22:
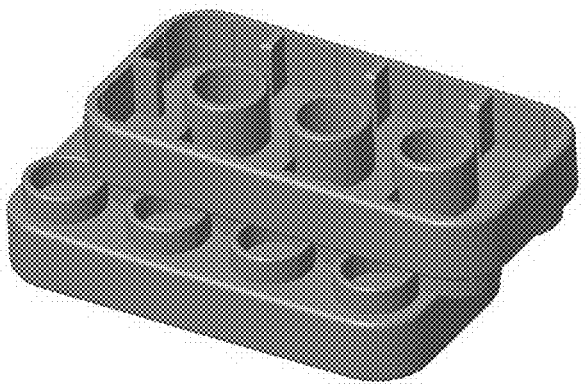
FIG. 22 is a schematic view showing the coupling between the front sides of two modules D according to the present invention.
Figure 23:
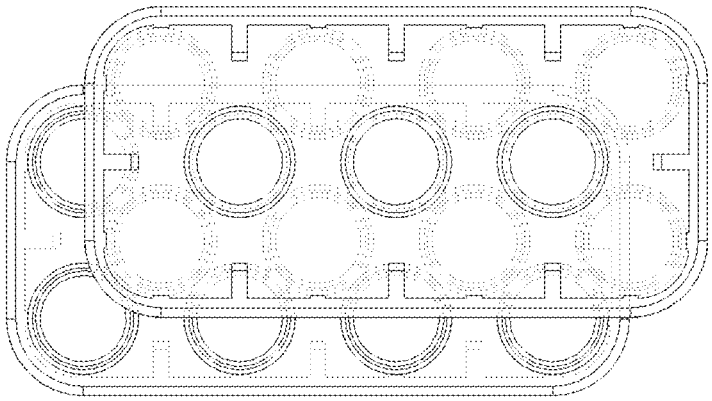
FIG. 23 is a schematic view of the size relationship between the short posts, the gap and the ribs when the front sides of two module D are coupled as shown in FIG. 22.

In one embodiment of the present invention, the nearest distance between the peripheries of two diagonally adjacent third coupling short posts s on the front side of the module D is the second size; the nearest distance between the peripheries of two diagonally adjacent fourth coupling short posts u on the back side of the module D is the second size; and the front side of the module D is adapted to be inserted into the back side of another module D. In the present embodiment, the front side of the module D is also adapted to be inserted into the front side of another module D. FIG. 22 FIG. 23 are schematic views showing the coupling between the front side of the module D and the front side of another module D.

In one embodiment of the present invention, the nearest distance between the peripheries of two coupling short posts s spaced apart by one third coupling short post s in the same row or column on the front side of the module D is the first size; and the front side of the module C is adapted to be inserted into the front side of the module D.

In one embodiment of the present invention, the nearest distance between the peripheries of two coupling short posts u spaced apart by one fourth coupling short post u in the same row or column on the back side of the module D is the first size; and the front side of the module C is adapted to be inserted into the back side of the module D.

In one embodiment of the present invention, the nearest distance between two second coupling short posts tin a diagonal direction on the back side of the module C is the second size; the back side of the module C is adapted to be inserted into the back side of the module D; and the back side of the module C is adapted to be inserted into the front side of the module D.

In one embodiment of the present invention, a plurality of ribs are disposed on a side wall of the concave surface on the back side of the module C. A plurality of ribs are disposed on a side wall of the concave surface on the back side of the module D. The ribs on the back side of the module D are perpendicular to the side wall, and are arranged in rows or columns directly opposite to the fourth coupling short posts u.

In one embodiment of the present invention, when the number of the first coupling short posts r on the front side of the module C is the same as the number of the rows or columns of the third coupling short posts s on the front side of the module D, the width or length of the module C is two times that of the module D.

In one embodiment of the present invention, when the module D is provided with two third coupling short posts s in the same row, the relationship between the outer diameter of the second coupling short post t, the outer diameter of the third coupling short post s and the outer diameter of the fourth coupling short post u and the width size of the module D is:

The outer diameter of the coupling short post is: $d(t)=d(s)=d(u)=X/2-g*2-h*2$;

wherein X is the width of the module D; g is the thickness of the side wall of the module D; and h is the thickness of the ribs on the side wall of the module D.

The diameter d(r) of the first coupling short post r is equal to the distance f between circle centers of two adjacent second coupling short posts t minus d(t); and the distance f between the circle centers of two adjacent second coupling short posts t is the same as the width of the module D.

For example, the width of the module D is 20 mm; the thickness g of the side wall of the module D is 1.2 mm; the thickness h of the ribs on the side wall of the module D is 0.25 mm; and the outer diameter d(s) of the second coupling short post s equals the outer diameter d(t) of the third coupling short post t, equals the outer diameter d(u) of the fourth coupling short post u, and equals 7.1 mm.

The diameter d(r) of the first coupling short post (r) is equal to the distance f between the circle centers of two adjacent second coupling short posts t minus d(t), i.e., 20−7.1=12.9 mm.

During practical design, in order to generate friction, the actual diameter d(r) and the actual diameter d(s, t, u) will be slightly greater than 12.9 mm and 7.1 mm, respectively, for example, 0.01-0.10 mm greater than 12.9 mm and 7.1 mm, respectively.

Figure 11:
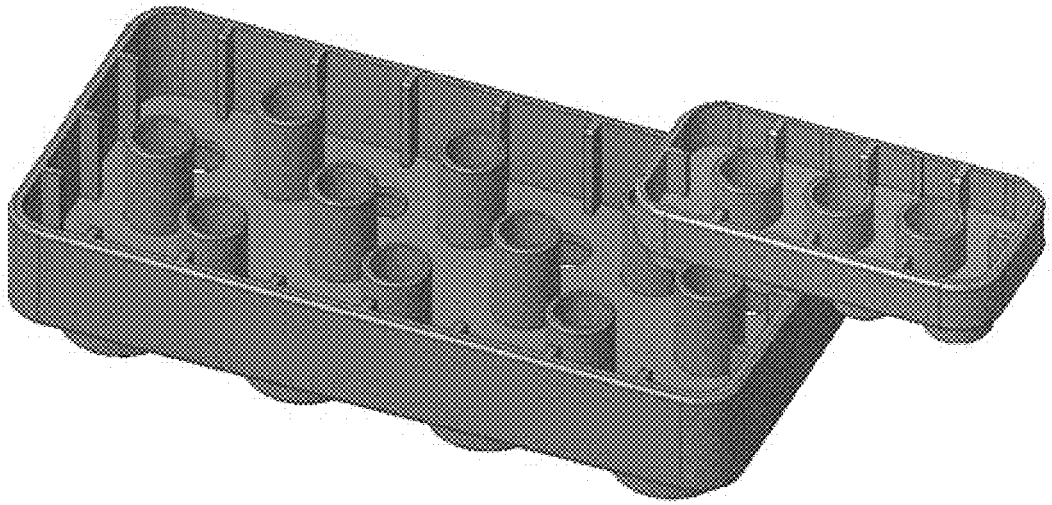
FIG. 11 is a schematic view showing the coupling between the back side of the module C and the front side of the module D according to the present invention.
Figure 12:
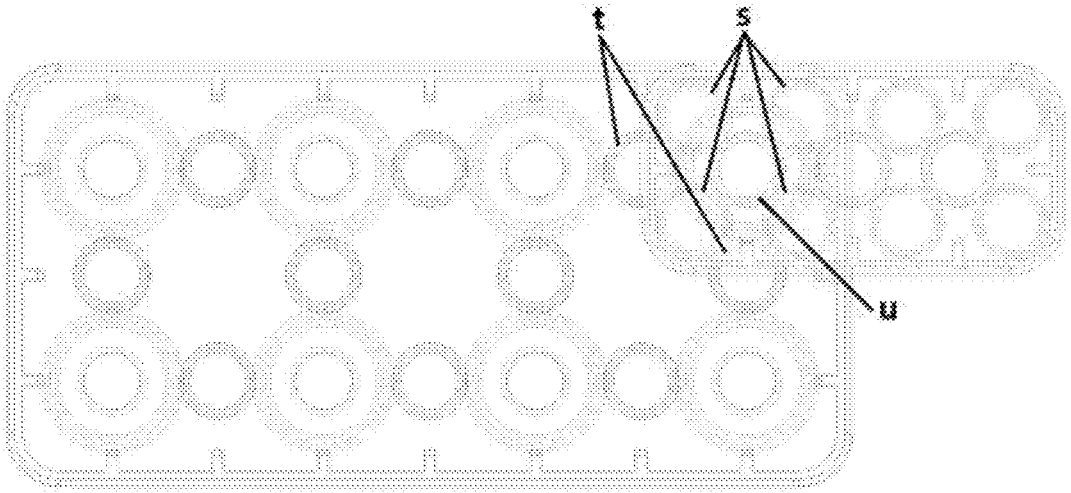
FIG. 12 schematically shows the coupling principle of the coupling relationship in FIG. 11 according to the present invention.

Such a smart design endows the present invention a multidimensional freely-buildable attribute. FIG. 11 is a schematic view showing the coupling between the back side of the module C and the front side of the module D. FIG. 12 schematically shows the coupling principle of the coupling relationship in FIG. 11, which illustrates that the coupling succeeds owing to the designs of the coupling short posts r, s, t, and u on the module C and the module D.

Figure 13:
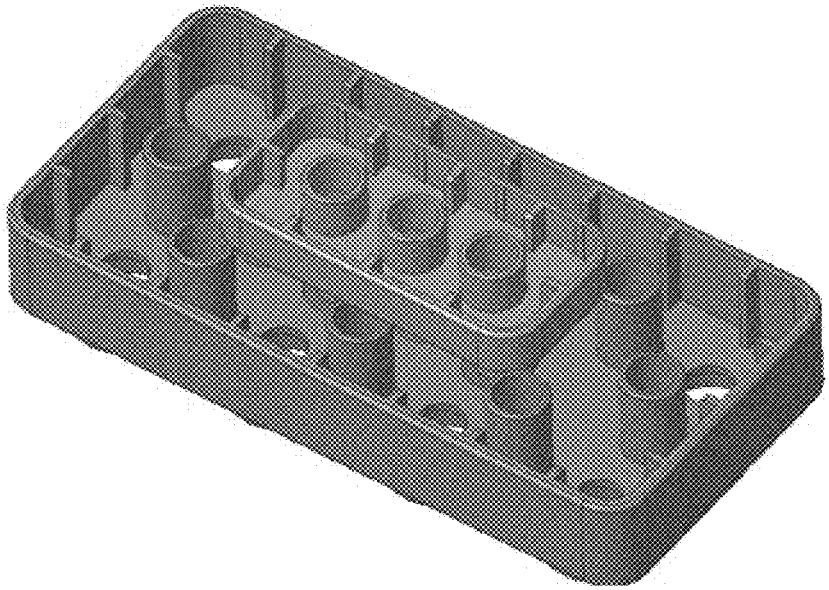
FIG. 13 is a schematic view showing the coupling between the back side of the module C and the front side of the module D at a randomly changed position.
Figure 14:
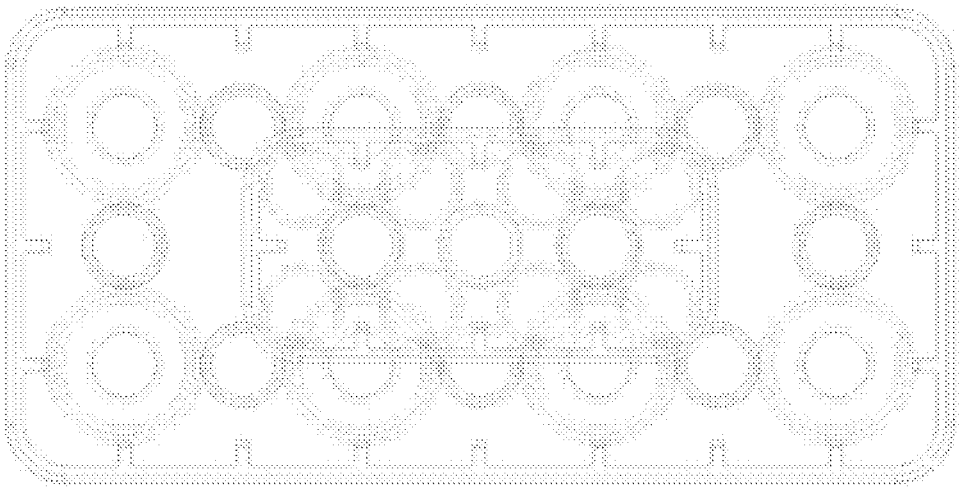
FIG. 14 schematically shows the coupling principle of the coupling relationship in FIG. 13.

FIG. 13 is a schematic view showing the coupling between the back side of the module C and the front side of the module D at a randomly changed position. FIG. 14 schematically shows the coupling principle of the coupling relationship in FIG. 13. The module D can be freely and successfully coupled to the module C whether they are coupled at any position, owing to the designs of the coupling short posts r, s, t, and u on the module C and the module D.

Figure 15:
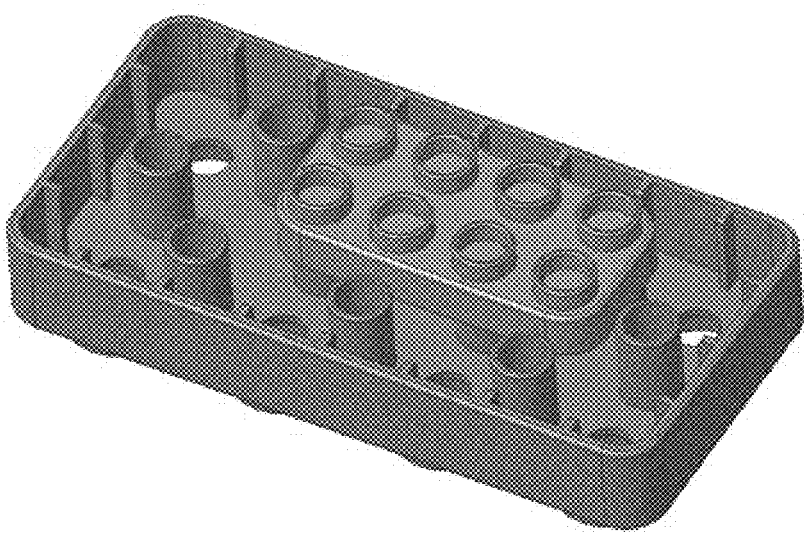
FIG. 15 is a schematic view showing the coupling between the back side of the module C and the back side of the module D according to the present invention.
Figure 16:
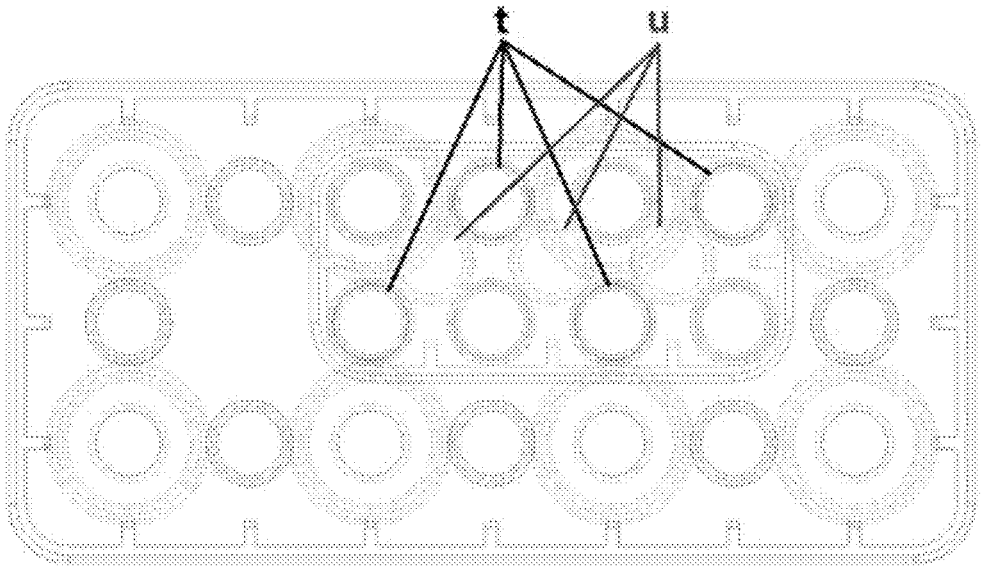
FIG. 16 schematically shows the coupling principle of the coupling relationship in FIG. 15.

FIG. 15 is a schematic view showing the coupling between the back side of the module C and the back side of the module D according to the present invention. FIG. 16 schematically shows the coupling principle of the coupling relationship in FIG. 15. The coupling is free and succeeds owing to the designs of the coupling short posts r, s, t, and u on the module C and the module D.

Figure 17:
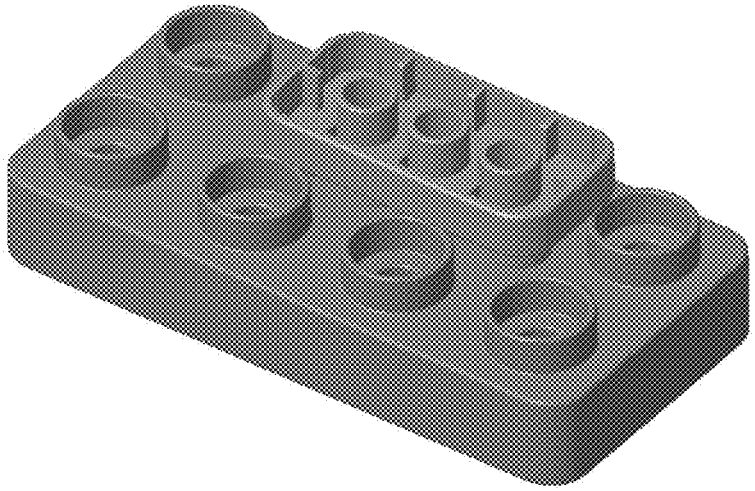
FIG. 17 is a schematic view showing the coupling between the front side of the module C and the front side of the module D according to the present invention.
Figure 18:
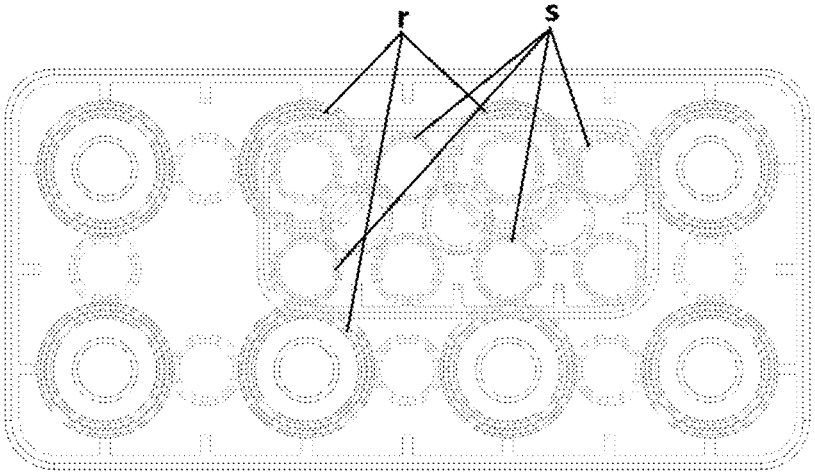
FIG. 18 schematically shows the coupling principle of the coupling relationship in FIG. 17.

FIG. 17 is a schematic view showing the coupling between the front side of the module C and the front side of the module D according to the present invention. FIG. 18 schematically shows the coupling principle of the coupling relationship in FIG. 17. The coupling is free and succeeds owing to the designs of the coupling short posts r, s, t, and u on the module C and the module D.

Figure 19:
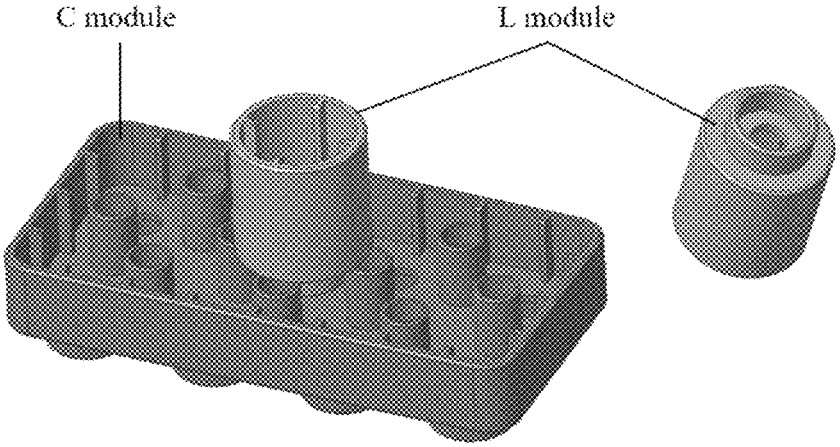
FIG. 19 is a schematic view showing the coupling between the module C and the module L are coupled.

FIG. 19 is a schematic view showing the coupling between the back side of the module C and the front side of the module L according to the present invention. The coupling is free and succeeds owing to the designs of the coupling short posts r and t on the front side and back side of the module C.

It can be seen from the description above that, by using the multidimensional front-and-back-sides-freely-buildable building block toy construction set of the present invention, apart from the building of the module C itself and the free building of conventional building blocks, the present invention provides freer building capability and building hand feeling in the following various building methods:

I. The coupling between the front side of the module C and the back side of the module D: the coupling short posts r are coupled to the coupling short posts u and the side wall of the module D to generate friction. Since the deformation of the side wall is small, such a method can better control the coupling friction and provide an experience with improved hand feeling.

II. The coupling between the back side of the module C and the front side of the module D: the side wall of the module C and the coupling short posts t are coupled to the coupling short posts s on the front side of the module D to generate friction. The design of the present invention can realize coupling at any position.

III. The coupling between the back side of the module C and the back side of the module D: the coupling short posts s, t, and u have the same diameter; and therefore, the back side of the module C and the back side of the module D can be coupled and built arbitrarily.

IV. The coupling between the front side of the module C and the front side of the module D: as shown in FIG. 17 and FIG. 18, the coupling short posts s and u on the front side and back side of the module D have the same diameter; therefore, besides the coupling between the back side of the module D and the front side of the module C, the front side of the module D can also be coupled to the front side of the module C arbitrarily; and this feature will be more prominent especially when the module C is a very large flat board component (for example, with a size of 50 CM*50 CM).

V. The coupling between the back side of the module C and the front side of the module L: as shown in FIG. 19, the module L is an implementation case of the module C, and is provided with only one coupling short post on the front side; furthermore, the diameter of the coupling short post is the same as r; therefore, the module L can be coupled to any position on the back side of the module C, thereby providing a lot of space for changes and design.

XI. The number of the coupling short posts on the front side of the module C/D is not limited to 8; the figure in the present invention is only illustrative; and the coupling short posts can be numerous such as 1, 2, 3 . . . 5 . . . 10 . . . 20 . . . 50 . . . and so on in number, thereby providing imaginable building pleasure.

Figure 20:
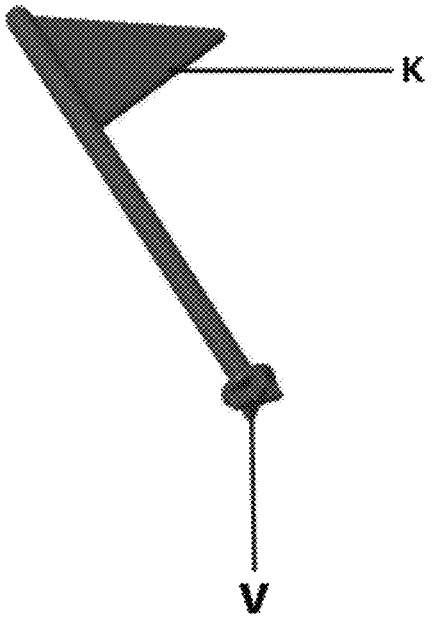
FIG. 20 is a schematic view of a module K, and shows that the module k can be inserted in a through hole of the module C via a post head v.

In addition, the present invention further provides some components having special structures for freely and stably building the modules. FIG. 20 is a schematic view of the module K, and shows that the module K can be inserted in a through hole of the module C via the post head v.

The post head v on the module K is in an interference fit with an inner hole of the coupling short post r. For example, the diameter d(L) of the cruciform post head v is 10.8 mm; the diameter d(E) of the inner hole of the inserted short post r is designed to be 10.7 mm; and the friction is provided by means of excess interference.

Figure 21:
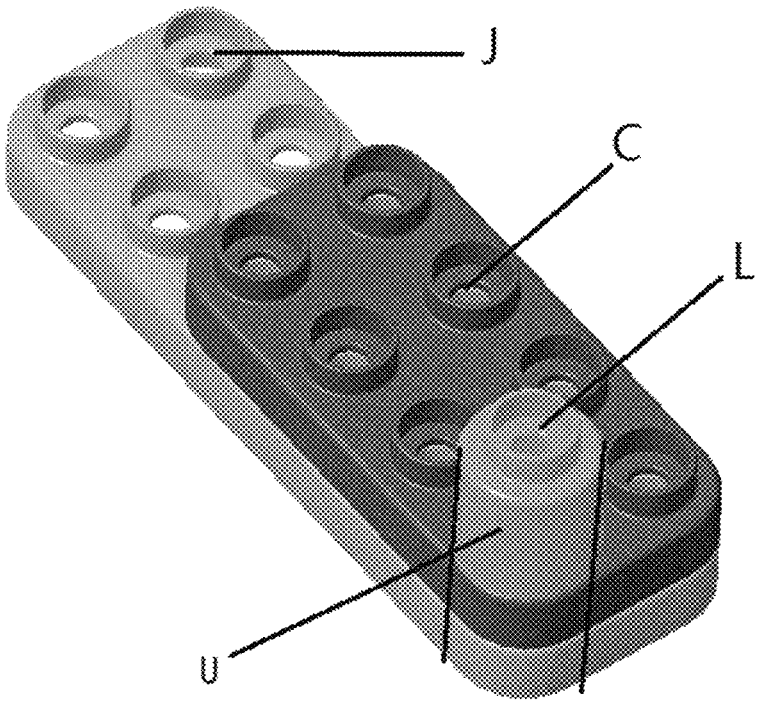
FIG. 21 shows that a plurality of unit modules C, L and J are built to form a uniform matched curved surface.

As shown in FIG. 21, in order to obtain a good building hand feeling and improve safety, the building block modules of the present invention are further smartly designed as follows:

The edges of the modules are all rounded corners; the coupling posts of the modules and the U-shaped rounded corners at the edge have the same center of circle; therefore, a plurality of unit modules C, J, and L can be built to form a uniform matched curved surface U, thereby obtaining a more comfortable hand feeling, and a more uniform appearance after building.

The above introduction shows that in the present invention, by means of the smart structural design of the building block toy construction set, five free building modes, including the coupling between the front side of the module C and the back side of the module D, the coupling between the back side of the module C and the front side of the module D, the coupling between the back side of the module C and the back side of the module D, the coupling between the front side of the module C and the front side of the module D, and the coupling between the back side of the module C and the front side of the module L, are realized. The building of any components and modules are freer and safer, and provides a good hand feeling. It is easier to build different series and different designs of toys by using the building block toy construction set. Furthermore, the present invention has a uniform appearance and a comfortable hand feeling, and is easy to realize the creative idea of the builder, which has inestimable economic value.

What is claimed is:

1. A multidimensional front-and-back-sides-freely-buildable building block toy construction set, comprising a first module and a second module;

wherein a front side of the first module is provided with a plurality of first coupling posts, and a back side of the first module is provided with a concave surface;

a plurality of second coupling posts are disposed on and protrudes from the concave surface;

the plurality of second coupling posts are uniformly distributed in columns identical to columns of the plurality of first coupling posts on the front side, and in a middle equally dividing two adjacent columns of the columns of the plurality of first coupling posts;

in the columns of the plurality of first coupling posts on the front side, the plurality of second coupling posts are alternately arranged with the plurality of first coupling posts, and are located in a middle equally dividing two first coupling posts of the plurality of first coupling posts;

in a column located at the middle equally dividing the two adjacent columns of the columns of the plurality of first coupling posts, each of the plurality of second coupling posts is located at a middle position equally dividing two first coupling posts of the plurality of first coupling posts in one row;

a front side of the second module is provided with a plurality of third coupling posts; each third coupling post of the plurality of third coupling posts is a cylinder penetrating the second module;

a back side of the second module is provided with a concave surface; a plurality of fourth coupling posts are disposed on and protrudes from the concave surface of the second module;

wherein the plurality of fourth coupling posts are distributed in columns located in a middle equally dividing two adjacent columns of the plurality of third coupling posts;

each fourth coupling post of the plurality of fourth coupling posts is located in a middle equally dividing two third coupling posts of the plurality of third coupling posts;

an outer diameter of each first coupling post of the plurality of first coupling posts is a first size;

an outer diameter of the each second coupling post, an outer diameter of the each third coupling post and an outer diameter of the each fourth coupling post are all a second size; and the first module and the second module are adapted to be inserted into each other;

wherein a nearest distance between peripheries of two adjacent first coupling posts of the plurality of first coupling posts on the front side of the first module is the second size;

a nearest distance between peripheries of two adjacent second coupling posts of the plurality of second coupling posts located in one row on the back side of the first module is the first size;

a nearest distance between peripheries of two adjacent second coupling posts of the plurality of second coupling posts located in one column is the first size; and the front side of the first module is adapted to be inserted into a back side of an adjacent first module;

a nearest distance between peripheries of two diagonally adjacent third coupling posts of the plurality of third coupling posts on the front side of the second module is the second size;

a nearest distance between peripheries of two diagonally adjacent fourth coupling posts of the plurality of fourth coupling posts on the back side of the second module is the second size; and the front side of the second module is adapted to be inserted into a back side of an adjacent second module.

2. The multidimensional front-and-back-sides-freely-buildable building block toy construction set according to claim 1, wherein the first size is different from the second size.

3. The multidimensional front-and-back-sides-freely-buildable building block toy construction set according to claim 2, wherein the first size is greater than the second size.

4. The multidimensional front-and-back-sides-freely-buildable building block toy construction set according to claim 1, wherein the front side of the second module is adapted to be inserted into a front side of the adjacent second module.

5. The multidimensional front-and-back-sides-freely-buildable building block toy construction set according to claim 1, wherein a nearest distance between peripheries of two third coupling posts spaced apart by one third coupling post in one row or column on the front side of the second module is the first size; and the front side of the first module is adapted to be inserted into the front side of the second module.

6. The multidimensional front-and-back-sides-freely-buildable building block toy construction set according to claim 1, wherein a nearest distance between peripheries of two fourth coupling posts spaced apart by one fourth coupling post in one row or column on the back side of the second module is the first size; and the front side of the first module is adapted to be inserted into the back side of the second module.

7. The multidimensional front-and-back-sides-freely-buildable building block toy construction set according to claim 1, wherein a nearest distance between two second coupling posts of the plurality of second coupling posts in a diagonal direction on the back side of the first module is the second size; and the back side of the first module is adapted to be inserted into the back side of the second module; and the back side of the first module is adapted to be inserted into the front side of the second module.

8. The multidimensional front-and-back-sides-freely-buildable building block toy construction set according to claim 1, wherein a plurality of first ribs are disposed on a side wall of the concave surface on the back side of the first module;

a plurality of second ribs are disposed on a side wall of the concave surface on the back side of the second module;

the plurality of first ribs are perpendicular to the side wall of the concave surface on the back side of the first module, and the plurality of second ribs are perpendicular to side wall of the concave surface on the back side of the second module, and the plurality of second ribs are arranged in rows or columns directly opposite to the plurality of fourth coupling posts.

9. The multidimensional front-and-back-sides-freely-buildable building block toy construction set according to claim 8, wherein when a number of rows and a number of the columns of the plurality of first coupling posts on the front side of the first module is respectively the same as a number of rows and a number of columns of the plurality of third coupling posts on the front side of the second module, a width of the first module is two times a width of the second module, and a length of the first module is two times a length of the second module.

10. The multidimensional front-and-back-sides-freely-buildable building block toy construction set according to claim 9, wherein when the second module is provided with two third coupling posts in one row, a relationship between the outer diameter d(t) of the each second coupling post, the outer diameter d(s) of the each third coupling post and the outer diameter d(u) of the each fourth coupling post and the width of the second module is:

$$d(t)=d(s)=d(u)=X/2-g*2-h*2;$$

wherein X is the width of the second module; g is a thickness of the side wall of the second module; and his a thickness of each rib of the plurality of second ribs on the side wall of the second module.

11. The multidimensional front-and-back-sides-freely-buildable building block toy construction set according to claim 10, wherein the outer diameter d(r) of the each first coupling post is equal to a distance f between circle centers of two adjacent second coupling posts of the plurality of second coupling posts minus the outer diameter d(t) of the each second coupling post; and the distance f between the circle centers of the two adjacent second coupling posts is the same as the width of the second module.

12. The multidimensional front-and-back-sides-freely-buildable building block toy construction set according to claim 11, wherein the width of the second module is 20 mm;

the thickness g of the side wall of the second module is 1.2 mm;

the thickness h of the each rib on the side wall of the second module is 0.25 mm; and the outer diameter d(s) of the each second coupling post equals the outer diameter d(t) of the each third coupling post, equals the outer diameter d(u) of the each fourth coupling post, and equals 7.1 mm.

13. The multidimensional front-and-back-sides-freely-buildable building block toy construction set according to claim 12, wherein the outer diameter d(r) of the each first coupling post is equal to the distance f between the circle centers of the two adjacent second coupling posts minus the outer diameter d(t) of the each second coupling post, and equals 20−7.1=12.9 mm.

14. A multidimensional front-and-back-sides-freely-buildable building block toy construction element, comprising a first module, wherein a front side of the first module is provided with a plurality of first coupling posts, and a back side of the first module is provided with a concave surface;

a plurality of second coupling posts are disposed in columns on the concave surface and protrudes from the concave surface;

the plurality of second coupling posts are uniformly distributed in the columns identical to columns of the plurality of first coupling posts, and in a middle equally dividing two adjacent columns of the columns of the plurality of first coupling posts;

in the columns of the plurality of first coupling posts, the plurality of second coupling posts are alternately arranged with the plurality of first coupling posts, and are located in a middle equally dividing two first coupling posts of the plurality of first coupling posts;

in a column located at the middle equally dividing the two adjacent columns of the plurality of first coupling posts, each of the plurality of second coupling posts is located at a middle position equally dividing two first coupling posts of the plurality of first coupling posts in one row;

an outer diameter of each first coupling post of the plurality of first coupling posts on the front side of the first module is a first size;

a nearest distance between peripheries of two adjacent first coupling posts of the plurality of first coupling posts on the front side is a second size;

an outer diameter of each second coupling post of the plurality of second coupling posts on the back side of the first module is the second size;

a nearest distance between peripheries of two adjacent second coupling posts in one row is the first size;

a nearest distance between peripheries of two adjacent second coupling posts in one column is the first size;

the front side of the first module is adapted to be inserted into a back side of an adjacent first module; and the first module is adapted to be inserted into a second module;

a front side of the second module is provided with a plurality of third coupling posts, and a back side of the second module is provided with a plurality of fourth coupling posts; and an outer diameter of each third coupling post of the plurality of third coupling posts and an outer diameter of each fourth coupling post of the plurality of fourth coupling posts are both the second size;

wherein the each third coupling post on the front side of the second module is a cylinder penetrating the second module;

the back side of the second module is provided with a concave surface; of the plurality of fourth coupling posts are disposed on and protrudes from the concave surface of the second module;

the plurality of fourth coupling posts are distributed in columns located in a middle equally dividing two adjacent columns of the plurality of third coupling posts; and each of the plurality of fourth coupling posts is located in a middle equally dividing two third coupling posts of the plurality of third coupling posts;

wherein a nearest distance between peripheries of two third coupling posts spaced apart by one third coupling post in one row or column on the front side of the second module is the first size; and the front side of the first module is adapted to be inserted into the front side of the second module.

15. The multidimensional front-and-back-sides-freely-buildable building block toy construction element according to claim 14, wherein a nearest distance between peripheries of two fourth coupling posts spaced apart by one fourth coupling post in one row or column on the back side of the second module is the first size; and the front side of the first module is adapted to be inserted into the back side of the second module.

16. The multidimensional front-and-back-sides-freely-buildable building block toy construction element according to claim 14, wherein a nearest distance between two second coupling posts of the plurality of second coupling posts in a diagonal direction on the back side of the first module is the second size; and the back side of the first module is adapted to be inserted into the back side of the second module; and the back side of the first module is adapted to be inserted into the front side of the second module.

17. A multidimensional front-and-back-sides-freely-buildable building block toy construction element, comprising a second module;

wherein the second module is adapted to be inserted into a first module;

a front side of the first module is provided with a plurality of first coupling posts, and a back side of the first module is provided with a plurality of second coupling posts;

a front side of the second module is provided with a plurality of third coupling posts;

each third coupling post of the plurality of third coupling posts is a cylinder penetrating the second module;

a back side of the second module is provided with a concave surface;

a plurality of fourth coupling posts are disposed on and protrudes from the concave surface;

the plurality of fourth coupling posts are distributed in columns located in a middle equally dividing two adjacent columns of the plurality of third coupling posts;

each of the plurality of fourth coupling posts is located in a middle equally dividing two third coupling posts of the plurality of third coupling posts;

an outer diameter of each first coupling post of the plurality of first coupling posts is a first size;

an outer diameter of each second coupling post of the plurality of second coupling posts, an outer diameter of each third coupling post of the plurality of third coupling posts and an outer diameter of each fourth coupling post of the plurality of fourth coupling posts are all a second size;

wherein a nearest distance between peripheries of two diagonally adjacent third coupling posts of the plurality of third coupling posts on the front side of the second module is the second size;

a nearest distance between peripheries of two diagonally adjacent fourth coupling posts of the plurality of fourth coupling posts on the back side of the second module is the second size; and the front side of the second module is adapted to be inserted into a back side of an adjacent second module; and a front side of the second module is adapted to be inserted into the front side of the adjacent second module.

18. The multidimensional front-and-back-sides-freely-buildable building block toy construction element according to claim 17, wherein the back side of the first module is provided with a concave surface; the plurality of second coupling posts are disposed in columns on the concave surface and protrudes from the concave surface of the first module;

the plurality of second coupling posts are uniformly distributed in the columns identical to columns of the plurality of first coupling posts, and in a middle equally dividing two adjacent columns of the columns of the plurality of first coupling posts;

in the columns of the plurality of first coupling posts, each of the plurality of second coupling posts is alternately arranged with the plurality of first coupling posts, and is located in a middle equally dividing two first coupling posts of the plurality of first coupling posts;

in a column located at the middle equally dividing the two adjacent columns of the plurality of first coupling posts, each of the plurality of second coupling posts is located at a middle position equally dividing two first coupling posts of the plurality of first coupling posts in one row; and a nearest distance between peripheries of two adjacent first coupling posts of the plurality of first coupling posts on the front side of the first module is the second size.

19. The multidimensional front-and-back-sides-freely-buildable building block toy construction element according to claim 18, wherein a nearest distance between peripheries of two third coupling posts spaced apart by one third coupling post in one row or column on the front side of the second module is the first size; and the front side of the first module is adapted to be inserted into the front side of the second module.

20. The multidimensional front-and-back-sides-freely-buildable building block toy construction element according to claim 18, wherein a nearest distance between peripheries of two fourth coupling posts spaced apart by one fourth coupling post in one row or column on the back side of the second module is the first size; and the front side of the first module is adapted to be inserted into the back side of the second module.

21. The multidimensional front-and-back-sides-freely-buildable building block toy construction element according to claim 18, wherein a nearest distance between two second coupling posts of the plurality of second coupling posts in a diagonal direction on the back side of the first module is the second size; and the back side of the first module is adapted to be inserted into the back side of the second module; and the back side of the first module is adapted to be inserted into the front side of the second module.

* * * * *